US008393309B1

(12) United States Patent
Blundy et al.

(10) Patent No.: US 8,393,309 B1
(45) Date of Patent: Mar. 12, 2013

(54) FUEL PRIMING ASSEMBLY

(75) Inventors: George R. Blundy, Walled Lake, MI (US); Ram D. Bedi, Bloomfield Township, MI (US)

(73) Assignee: K.J. Manufacturing, Co., Wixom, MI (US)

( * ) Notice: Subject to any disclaimer, the term of this patent is extended or adjusted under 35 U.S.C. 154(b) by 307 days.

(21) Appl. No.: 12/696,383

(22) Filed: Jan. 29, 2010

Related U.S. Application Data

(60) Provisional application No. 61/148,229, filed on Jan. 29, 2009.

(51) Int. Cl.
*F02M 63/00* (2006.01)

(52) U.S. Cl. ..... 123/179.9

(58) Field of Classification Search ..... 123/179.9, 123/455, 468, 469
See application file for complete search history.

(56) References Cited

U.S. PATENT DOCUMENTS 2,945,483 A * 7/1960 Howell ..... 123/179.8
3,750,639 A * 8/1973 DiGirolamo ..... 123/179.13
3,929,645 A * 12/1975 Bugelski et al. ..... 210/251
4,602,599 A * 7/1986 Glagola ..... 123/179.9
4,747,377 A * 5/1988 Schaller ..... 123/179.16
5,664,532 A * 9/1997 August ..... 123/179.11
5,853,575 A * 12/1998 Wydra et al. ..... 210/136
6,022,473 A * 2/2000 Mickelson ..... 210/86
6,305,357 B1 * 10/2001 Soukeras ..... 123/495
6,569,320 B1 * 5/2003 Bedi et al. ..... 210/94
7,967,151 B1 * 6/2011 Bedi et al. ..... 210/416.4
2002/0062822 A1 * 5/2002 Watanabe et al. ..... 123/527

* cited by examiner

*Primary Examiner* — Stephen K Cronin
*Assistant Examiner* — Arnold Castro
(74) *Attorney, Agent, or Firm* — Young Basile Hanlon & MacFarlane, P.C.; Denise M. Glassmeyer

(57) ABSTRACT

A fuel priming device comprising: means for establishing releasable fluid communication with an interior volume of a fuel conveying system of an engine; a first conduit affixed to the releasable communication means for conveying diesel fuel from an engine; a pressurizable reservoir in fluid communication with the fuel conveying conduit, the device located external to the automotive vehicle associated and at least on pneumatic system controlling the removal of fuel from the diesel fuel filter.

7 Claims, 4 Drawing Sheets

FUEL PRIMING ASSEMBLY

CROSS REFERENCE TO RELATED APPLICATIONS

This application claims the benefit of provisional patent application 61/148,229 filed on Jan. 29, 2009.

The present invention is directed to a method and apparatus for priming an engine fuel filter, particularly in diesel engine configurations.

Diesel engine filters must be routinely changed to insure proper function of the associated engine. These devices tend to hold significant quantities of residual fuel.

Removal of diesel engine filters is an opportunity for spillage of the fuel which is contained in the filter housing. This poses a risk of environmental contamination and, can jeopardize worker safety. Thus the filter units to be changed or removed must be handled carefully to minimize these risks. This can add time and complexity to filter change operations and does not completely eliminate the risks outlined and associated with filter change operations. Additionally removal of the fuel with the associated filter wastes fuel that could be otherwise used in engine operations. Recovery of the fuel could provide additional cost savings in engine operation and use.

Additionally, there are various repair operations that require action on the fuel line region and the removal of a portion of the diesel fuel contained therein. In order to accomplish optimum engine function and minimize engine wear, it is necessary to prime the filter and fuel delivery system surrounding the diesel filter before resuming normal engine operations. This can become even more important in engine configurations having more than one fuel filter unit.

Heretofore various attempts have been made to address and overcome the problems associated with changing engine fuel filters, including but not limited to, the device and method outlined in U.S. Pat. No. 6,569,320 to Bedi. In U.S. '320, a suitably configured fuel filter mount can be configured with quick connect couplers to releasably communicate with a reservoir for collecting fuel out of a filter, conditioning it and reintroducing it into the fuel filter upon the completion of fuel filter change operations. The device provides filter change capability for engines having limited filter volume but is not configured for vehicles having large volume filter devices.

Due to the typical volume of the diesel fuel filter, the newly positioned replacement filter must be charged with a suitable volume of fuel before starting the engine in order to obtain maximum engine efficiency and fuel usage. Thus fuel filter changes can also necessitate the additional step of charging the fuel filter with a volume of diesel fuel after the filter is in position. It has also been found that in engines with large volume filters, refilling the filter can introduce an air pocket in the fuel supply system that results in sputtering and suboptimal engine performance on engine restart.

Thus it would be desirable to provide a fast and efficient method for removing engine fuel from the filter prior to, or during the filter element change operation and replacing the fuel after replacement of the filter element. It would also be desirable to provide a method and device which would facilitate the removal and replacement of the fuel filter element in a self-contained and efficient manner if desired or permit localized engine system repair and replacement of fuel as a result of engine maintenance.

SUMMARY

A fuel priming unit is disclosed herein that includes a means for establishing releasable fluid communication with an interior volume of a diesel engine fuel conveying system as well as a collection receptacle located external to an automotive vehicle associated with the diesel engine fuel conveying system. A first fuel conveying conduit is positioned between the communication establishing means and the collection vessel. The device has at least one pneumatic contact member configured to establish pneumatic contact between the device and at least one source of pressurized gas external to the device, and at least one pneumatically operable control operable during replacement of fuel into the fuel conveying system located in the diesel engine.

DESCRIPTION OF THE DRAWINGS

In order to more fully understand the present invention, the following drawing is presented in which like reference numbers are use throughout the various drawing figures and in which.

DESCRIPTION

Figure 1:
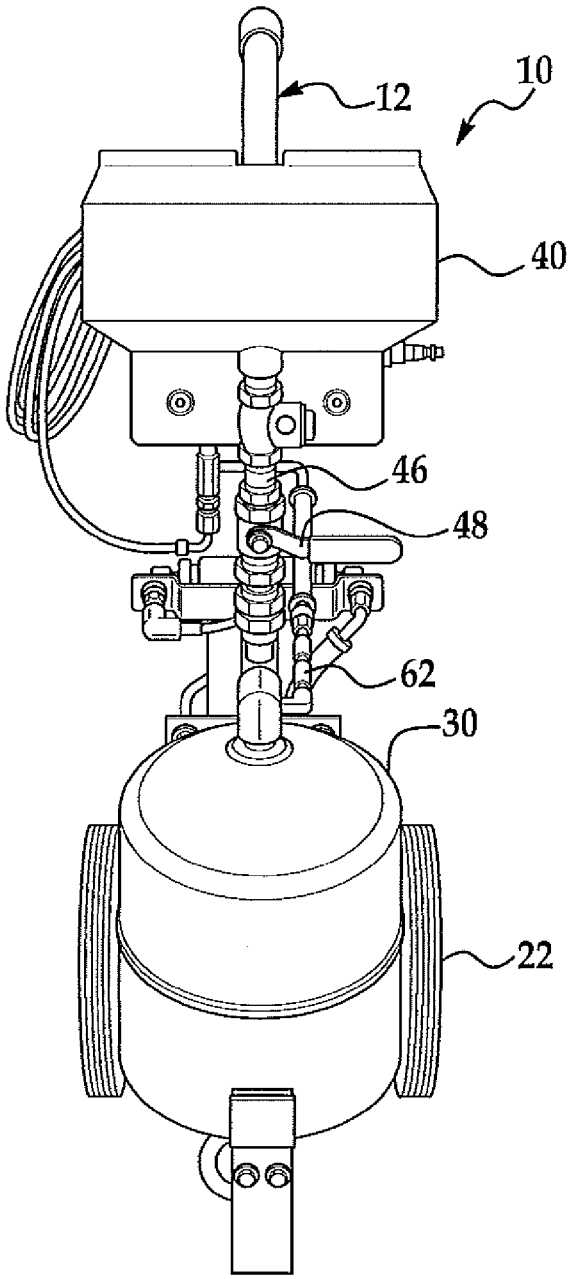
FIG. 1 is a front view of an embodiment of the fuel priming unit disclosed herein.

The device and associated method disclosed herein provide a quick and effective system for priming fuel into a system such as a diesel engine. Particularly, the device and associated method disclosed herein facilitate introduction of fuel into at least one diesel fuel filter associated with the engine and conduits in fluid connection therewith. The device and method achieves introduction of diesel fuel into associated fuel conveyance line(s) conveying diesel fuel to the engine downstream and/or upstream of the fuel filter in a manner that prevents or eliminates entrained air in the fuel conveyance system. The method and/or device includes at least one pneumatic controller.

The device disclosed herein provides an integrated, self-contained means for efficient and effective return of diesel fuel to an engine fuel filter during filter as would be required change operations. Because the fuel priming operations are relatively easy and self-contained, it is envisioned that the device will facilitate and streamline fuel priming operations such as those associated with filter change procedures as well as other maintenance operations. This can result in cost savings and time savings as well as improving engine performance and/or longevity. It is also envisioned that the device and associated method can contribute to environmental quality by providing a self-contained modality of achieving fuel priming thereby eliminating the opportunity for fuel spillage and waste. It is also believed that the device and associated method can also provide a device that will ensure delivery of a measured quantity of fuel into the engine during priming operations according to desired or predetermined specifications. It can be appreciated that the device and associated method can provide one or more of the foregoing attributes as well as other desirable advantages or attributes that have not yet been discussed or discovered.

Various systems for fuel removal and replacement have been proposed and employed. Among these is a device and method presented by the present inventors as U.S. Pat. No. 6,569,320. The content of that disclosure is incorporated by reference herein. It has been found, quite unexpectedly that the pressure/pneumatic system disclosed herein can achieve effective and efficient fuel priming operations over those disclosed in any methods and devices such as previously described and disclosed by the present inventors.

Broadly construed, the device disclosed herein includes a housing or cart configured to be positioned external to the device utilizing a diesel engine such as an automotive vehicle in need of service. The device has a diesel fuel receptacle associated with the housing or cart and a first conduit in fluid communication with the diesel fuel collection reservoir. The first conduit has means for establishing releasable fluid communication with the interior volume of the fuel conveying conduit structure of the associated engine at a location proximate to one or more diesel fuel filter(s). The device also includes means for utilizing pressurized gas in at least one of the fuel priming step and/or the timing of the priming step. The device may also include at least one fuel introduction element configured to facilitate introduction of quantities of fuel, particularly measured quantities of fuel, into the fuel reservoir from sources external to the device and associated engine. The device also includes suitable control mechanism (s). Typically, the device includes at least one pneumatically operable control mechanism.

Figure 2:
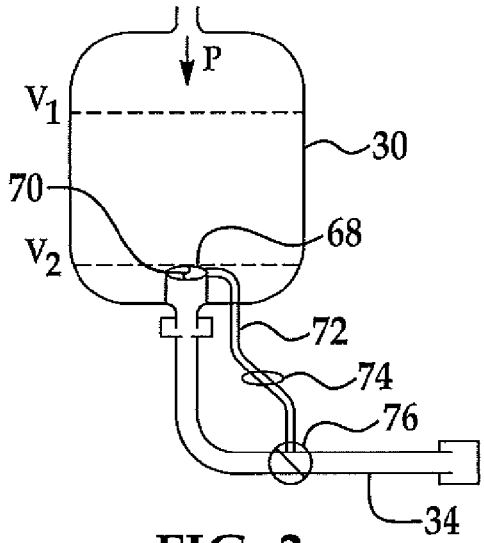
FIG. 2 is a schematic depiction of the pressurizable reservoir of an embodiment as disclosed herein schematically depicting a fluid delivery control system.
Figure 3:
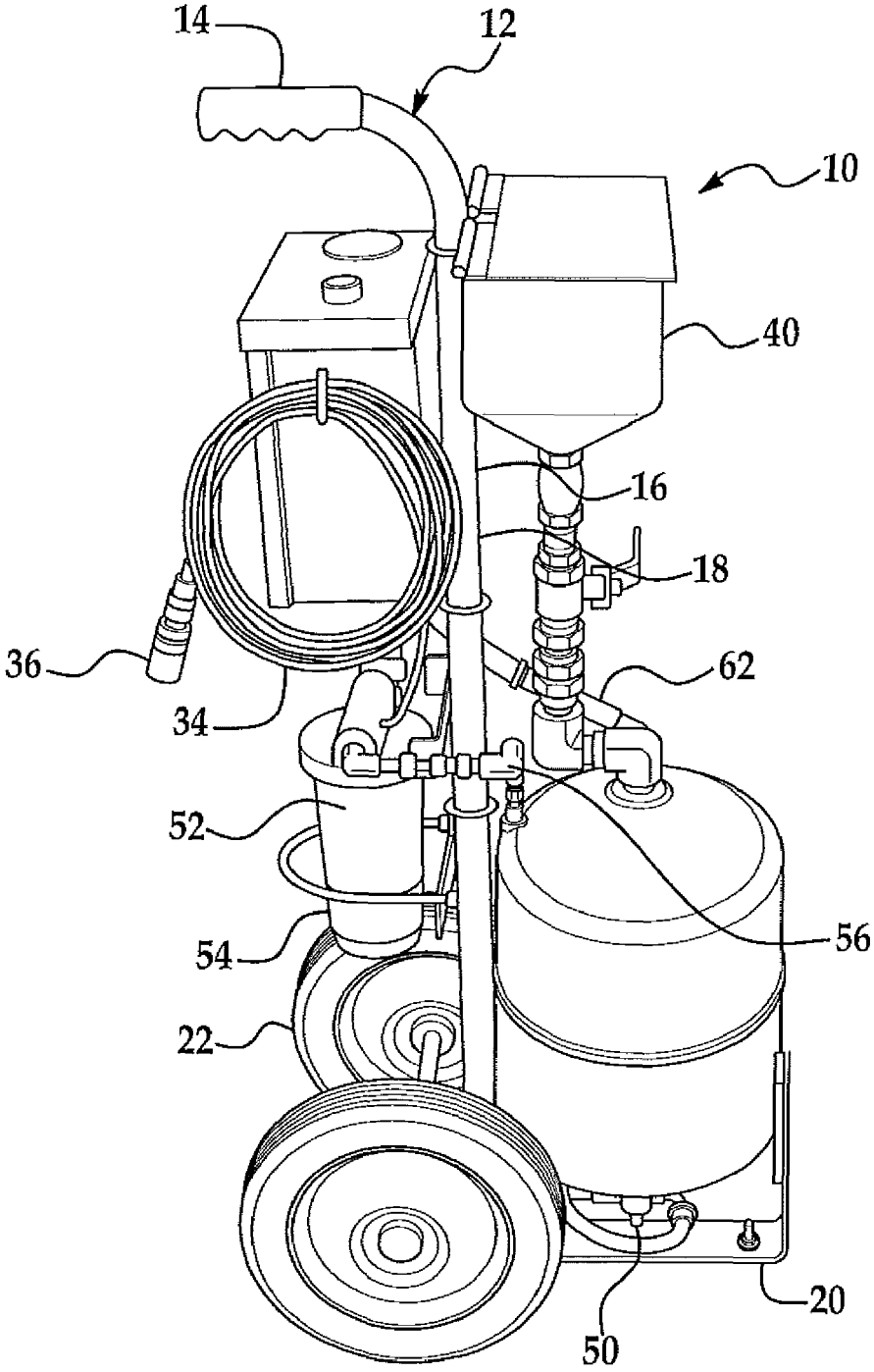
FIG. 3 is a side view of the embodiment of the device of FIG. 1.
Figure 4:
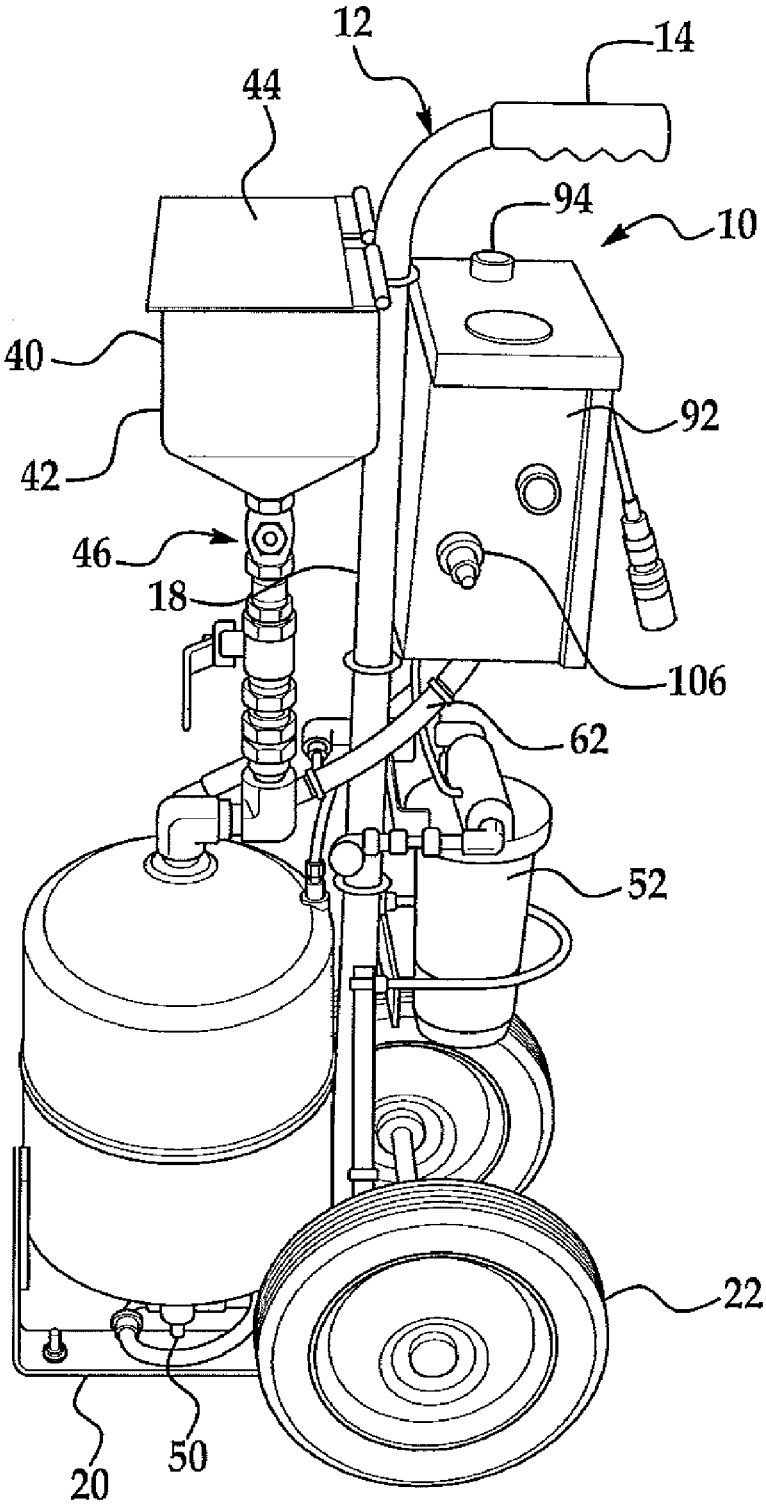
FIG. 4 is a alternate side view of an embodiment of the device of FIG. 1.

The device 10 as depicted in FIGS. 1, 2 and 3 can be configured as a stationary unit or a mobile unit. In the embodiment depicted in the drawing figures, the device 10 is a mobile unit configured with a housing (not shown) of cart 12 on which the various elements can be mounted. The cart 12 may have a suitable handle 14 connected to frame 16. Frame 16 may have a suitable back 18 and a base 20. Where desired or required, the base 20 may be configured with suitable locomotion aids such as skids (not shown) or wheels 22 operationally connected to the frame in any suitable manner. In the embodiment depicted in the drawing figures, the wheels are located at the junction between the back 18 and the base 20 in order to facilitate pivot of the device 10 about and axis defined through that junction.

It is contemplated that the various components of the device 10 can be affixed to the cart 12 by any suitable means.

Broadly construed, the device 10 disclosed herein is a fuel priming unit having a control means for introducing an amount of priming fluid (fuel) into that the fuel delivery and circulation system engine of an associated diesel engine under pressure conditions in which the introduction of the priming fuel occurs at either essentially stable high pressure or at increasing pressure over the introduction interval. When desired or required, the amount of priming fluid (fuel) can be premeasured or defined. It is contemplated that the device will be configured with suitable means to introduce the desired volume of priming fuel over a time-calibrated interval. The pressure value during introduction can be any suitable elevated pressure that will effectively introduce the priming fuel into that associated engine.

In the embodiment as depicted in the various drawing figures, the device 10 includes at least one pressurizable fuel reservoir 30 in fluid communication with a suitable primary fuel introduction mechanism 32. In the various embodiments as depicted in the drawing figures, the primary fuel introduction mechanism 32 is composed of a suitable conduit 34 configured to be detachably connectable with a suitable fitting 36 positioned in the fuel circulation system of the associated diesel engine (not shown).

While the associated fitting 36 positioned in the fuel circulation system of the engine may be positioned at any suitable location, in certain embodiments the associated fitting 36 will be located at or fluidly adjacent to at least one of the fuel filter units employed in the engine. In certain embodiments where more than one engine fuel filter is employed, it is contemplated that the associated fitting will be located fluidly adjacent to the upstream fuel filter relative to delivery of fuel into the engine.

The conduit may be constructed from any suitable material. In various embodiments, the conduit 34 is composed of a flexible fuel resistant material of a suitable length to extend from the device 10 to the associated vehicle to be serviced. In order to facilitate fluid communication between the device 10 and the associated vehicle, it is contemplated that the conduit 34 can be configured with a suitable mating fitting 38 to establish releasable fluid connection between device 10 and the associated engine (not shown). The associated engine can be configured with associated fitting 36 releasably connectable with fitting 38. In various embodiments, it is contemplated that the conduit fitting 38 may be a suitable locking coupling member such as a POSILOCK diagnostic connection.

The end of the conduit 34 distal to the conduit fitting 38 is in fluid communication with the at least one of the pressurizable fuel reservoir 30. The conduit 34 may be connected to the reservoir 30 at any suitable location to facilitate pressure assisted evacuation of at least a portion of fuel continued in the reservoir through the conduit and in to the fuel conveying lines of the associated diesel engine. In the embodiment depicted in the drawing figures, the connection between reservoir 30 and conduit 34 is positioned at a lower portion of the reservoir 30 when the device is positioned in the operational orientation.

The pressurizable fuel reservoir 30 will also be configured with means to introduce fuel into the fuel reservoir 30. It is contemplated that introduced fuel will be obtained from one of two sources. Fresh fuel can be introduced into the reservoir from any suitable location such as gas can, fuel pump or the like. Given the mobile nature of the device 10; the device 10 can be transported to a suitable fuel source when required. Fresh fuel, such as diesel fuel, can be introduced, and device 10 containing the introduced fuel can be transported to the location of the diesel engine regardless of proximity to the source of the fresh fuel.

Device 10 includes an upper reservoir 40 that is positioned above the pressurizable fuel reservoir 30 when the device is in the upright operational position. Upper reservoir 40 can have any suitable configuration and volume sufficient to hold a measured volume of diesel fuel to be used as priming material. In the embodiment depicted in FIGS. 1-4, the upper reservoir 40 is a covered chamber 42 with a pivotal or removable lid 44.

As depicted in the drawing figures, the conduit or conveyance path is depicted at reference numeral 46. In the embodiment as depicted the conduit 46 may include a suitable closure valve 48 which can be moved from an opened position during operations filling the pressurizable reservoir 30 with fuel and a closed position to be utilized at other times. By way of non-limiting example, the closure valve 48 will be closed during transit of the device 10 and during priming operations. In the embodiment depicted, the closure valve 48 is a hand operable valve located in the conduit medial between the upper reservoir 40 and the pressurizable fuel reservoir 30. The closure valve 48 can be configured to provide pressure tight closure between the conduit upper reservoir 40 and the fuel reservoir 30.

It is also contemplated that the conduit 46 can be configured with one or more suitable check valves such as ball valves, and the like to prevent the return of fuel into the upper reservoir once introduced into at least one pressurizable fuel reservoir 30 as desired or required.

It is also contemplated that the pressurizable fuel reservoir 30 can be configured with a suitable drain opening or spigot 50 configured to provide fluid access to the interior of the reservoir 30 as needed. It is contemplated that the drain valve or spigot 50 will be positioned in the lower portion of the reservoir 30 to permit drainage of any sediment, water or other material that may accumulate in the reservoir 30 over time. "Lower" is construed in the embodiments as a location when the device is in the use position as depicted in the drawing figures.

The fuel delivery conduit 34 can connect at any suitable location on the pressurizable reservoir 30 and can be connected by suitably fluid tight connection means. In various embodiments, it is contemplated that the fuel delivery conduit 34 can be connected to the pressurizable reservoir 30 at any suitable location. In various embodiments, it is contemplated that the fuel delivery conduit 34 will be located a position above the fluid level of spigot 50 but in the lower region of the reservoir 30. In many instances, it is contemplated that the conduit will be located in the lower third portion of the reservoir when the reservoir in the in upwardly oriented or use position.

In the embodiment depicted in the drawing figures, the fuel delivery conduit is located in the lower oriented face of the pressurizable reservoir 30. It is contemplated that the fuel delivery conduit can be located at an orientation higher than the spigot when the device 10 is oriented in the upright or use position.

The device 10 also includes at least one suitable onboard filtration unit 52 that is in fluid communication upstream of the pressurizable reservoir 30. The onboard filtration unit is located at a position upstream of the junction between the device and associated engine. As depicted, the onboard filtration unit is configured with an external housing 54 having at least one outlet in fluid communication with an intermediate conduit 56. The intermediate conduit 56 terminates in fluid communication with the at least one pressurizable fuel reservoir 30. The filtration unit can be configured to remove contaminants and other undesirable material form the fuel passing through it and as such may contain suitable filtration media and the like. The at least one onboard filtration unit 52 can be configured to be replaceable or to have a permanent housing with replaceable or refreshable filtration media as desired or required.

In order to minimize the accumulation of water and sediment in the pressurizable reservoir 30, the device 10 can also include at least one suitable filter configured to remove at least a portion of the entrained water and sediment present in fuel drawn from the fuel filtration unit 52. In the embodiment depicted in the drawing figures, it is contemplated that the unit can have any suitable filtration media such as filtration media having a sieve size of approximately 30 microns or smaller. Where desired or required, it is contemplated that various filter media can be provided as various sizes to trap or entrain various material. As a non-limiting example, filtration media capable of trapping and or entraining water particles as small as 100 microns may be employed in particular instances. One non-limiting example of suitable filtration media includes mesh screen.

Where desired or required, the filtration unit 52 or components thereof can be removable or replaceable. It is also contemplated that the filter device can be equipped with suitable means (not shown) for indicating filter replacement is required. Such indicator means can include, but need not be limited to, visual, electronic or non electronic signals triggered by events such as a change in condition of the filtration media or the volume of contaminant accumulated in the filtration unit 52. It is also contemplated that the filtration unit 52 can also be equipped with suitable self regeneration devices as desired or required.

In various embodiments, it is contemplated that the filtration unit 52 can contain suitable filtration media capable of removing contaminants from hydrocarbon materials such as diesel fuel. Such filtration media may comprise one or several different materials as required to accomplish suitable fuel filtration. It is anticipated that such filtration media will be capable of removing contaminants such as by-products of incomplete combustion of the diesel fuel as well as contaminants derived from the engine itself. Such contaminants include, but are not limited to, metallic or metal-base materials which result from the engine operation and parts contained therein. Other contaminants may include components derived from engine lubricants, seals and gaskets, and the like. Additionally, the filtration media contained in the associated filter unit 48 can be one which is capable of removing or sequestering various contaminants derived from the external environment such as road dirt particles and the like. Filtration media capable of such functions are known to those skilled in the art.

The filtration media employed in associated filtration unit 52 may be of a type which is removable from the associated filter unit on a periodic basis when the media becomes saturated or unable to provide suitable filtration function. Alternately, it is considered within the purview of this invention that the entire filter unit with filtration media contained therein will be removable from device 10 to permit replacement with a fresh filtration unit 52.

Thus, it is contemplated that diesel fuel contained in the pressurizable reservoir 30 will be essentially clean filter diesel fuel. Where necessary, it is contemplated that the receptacle can include suitable access ports such as drain 50 to permit external access to the fuel contained therein. In the embodiment depicted, the fuel conveying conduit is located at a position distant to the drain 50 such as a location near the top of the reservoir 30 when the device 10 is in its use position.

The device 10 can also include a suitable onboard filtration unit 52. The onboard filtration unit is located at a position upstream of the junction between the device and associated engine. As depicted, the onboard filtration unit is configured with an external housing 54 having at least one outlet in fluid communication with an intermediate conduit 56. The intermediate conduit 56 terminates in fluid communication with the at least one pressurizable fuel reservoir 30.

The intermediate conduit 56 may be configured in any suitable manner to convey the filtered fuel from the filtration unit 52 to the pressurizable fuel reservoir 30. In various embodiments, it is contemplated that the intermediate conduit 56 can be configured with suitable check valves and the like to prevent backflow of filtered fuel and to prevent back pressure in the filtration unit when the associated pressurizable fuel reservoir 30 is under elevated pressure.

In order to ascertain the volume of fuel contained in the pressurizable fuel reservoir 30, it is contemplated that the reservoir can be equipped with a suitable measurement tool such as sight glass or the like (not shown).

In various diesel engine configurations such operations must be followed with a post-service priming operation in which fuel is reintroduced into the high pressure pump over an interval of two minutes to insure that engine has a continuous supply of fuel upon start up.

Upon completion of routine maintenance, filter change operations and the like, the fuel contained in the pressurizable reservoir 30 can be reintroduced into the fuel conveyance system of the associated engine as by pressurization of the reservoir to make up for fuel lost during filter change operations and other maintenance. At least apportion of the fuel contained in the reservoir 30 can be conveyed back to the engine to prime the high pressure fuel pump and associated engine conduits through suitable conveyance hoses.

The device 10 includes suitable means for pressurizing the reservoir 30 when required. In the embodiments as depicted, the device 10 includes a suitable connection to a source of pressurized gas or air. While it is within the purview of the disclosure of this invention for the device to include a suitable compressor or pressurized air source, the embodiments depicted in the various drawing figures include a suitable means for releasably connecting to a source of pressurized gas external to the device 10.

When priming is required, the reservoir can be pressurized to a level sufficient to convey fuel into the high pressure fuel pump, filter units, and any associated fuel conveyance lines of the vehicle as may be desired or required.

The device 10 is configured to be operated pneumatically utilizing a suitable source of pressurized air. Where desired or required, the source of pressurized air can be derived from a suitable pump, source of bottled gas or other on-board source. It is also considered to be within the purview of this disclosure to obtain pressurized air form pressurized sources on board the associated vehicle being services such as the residual pressurized air contained in the compressor system of the vehicle. It is contemplated that the device 10 can be configured to be removably coupled to an external source of pressurized gas such as a suitable shop air line or the like. The embodiments depicted in the drawing figures contemplate the use of external shop air.

Suitable sources of pressurized gas or air will be those that can convey any suitable gaseous mixture including, but not limited to, conventional shop air, nitrogen and the like at pressures up to at least 125 psi. It is to be understood that in many situations shop gas is delivered at pressures greater than 125 psi. Elevated pressures can be utilized with delivery pressures up to and above 160 psi being contemplated in various situations. Where elevated delivery pressures are employed, it is contemplated that the device 10 can be equipped with suitable devices to step down the pressure value as desired or required.

The device 10 can include suitable coupling means to connect the device 10 to the source of pressurized gas. Where desired or required, the device 10 can include at least one pneumatic line to convey the pressurized air to desired location(s) in the device 10 as well as suitable regulators and devices to reduce and maintain the introduced shop air to a suitable operational level. In the embodiment depicted, it is contemplated that the external source will be configured to deliver priming fuel to the engine at a suitable operational pressure, for example 80 psi. This pressure is considered exemplary. It is considered within the purview of this disclosure to employ other delivery pressures as desired or required. The air pressure introduced into the device will be that sufficient ultimately to deliver priming fuel at the desired or required pressure. The device 10 can include suitable coupling members and pressure regulating devices to maintain a suitable operational pressure.

It is contemplated that pressurized gas or air can be introduced into the device 10 by a suitable conduit such as pneumatic line 62. Pneumatic line 62 can be equipped with suitable couplers as desired or required to connect the pneumatic line to the external gas source.

It is contemplated that the introduced pressurized gas can be introduced into reservoir 30 containing engine fuel in order to pressurize the interior of the vessel. In the embodiments as depicted, it is contemplated that the pressure delivery line 62 will be connected to the respective reservoir 30 at a location consistent with the headspace produced in the vessel.

Pressurization levels are that amount sufficient to push the fuel into the fuel delivery conduit 34 and into the high pressure pump associated with the engine and into associated engine conduits. The pressurized fuel introduction will proceed for an interval sufficient to achieve suitable priming. Specific pressurization levels and timing are generally prescribed by the engine manufacturer. In various applications, it is contemplated that priming will occur at an elevated pressure between about 60 and 100 psi for an interval between about 1 and 5 minutes, with pressures of 80 psi being utilized in certain situations and priming intervals of 2 minutes being prescribed.

It is contemplated that the device and method outlined herein can provide consistent high pressure priming over the entire interval desired in an efficient and effective manner. Introduction of pressurized gas occurs in a manner such that a pressure head is formed over the surface of the fuel contained in the reservoir 30 such that the fuel is pushed thought he conduit in a manner that precludes the introduction of air into the device to be primed.

Upon completing the priming step, pressurization can be discontinued and the device decoupled from the associated engine. The device 10 can be configured with suitable timers and pressurization discontinuation systems. The discontinuation devices can include, but need not be limited to fluid level controls and feed back systems located internally in the pressurization reservoir. It is contemplated that the reservoir 30 will be configured to contain a residual volume of fluid fuel material when the reservoir is in the non-filled state. The retained amount will generally be a volume sufficient to ensure introduction of a suitable quantity of replacement fuel at a suitable pressure during the fuel replacement phase of operations. In certain embodiments, it is contemplated that this residual flow amount will be approximately 1 to 4 quarts. The residual amount will be fresh diesel fuel that can be introduced into the receptacle by any suitable means such as through the upper chamber 40.

It is contemplated that the device 10 will include suitable level controllers and regulators to limit maximum volume contained in the reservoir 30 and limit maximum volume delivered from the reservoir 30 into the appropriate location such as the high pressure fuel pump and associated filter and associated engine conduits.

In the embodiment depicted in FIG. 2, an air pressure through float 68 is positioned in the interior of the pressurizable reservoir 30 and functions as a lower level limiting regulator in pneumatic contact with fuel delivery line 34. When fluid levels are at or below the level defined by float 68, movement of or action upon float valve 70 can trigger a suitable message to terminate pressurization of the reservoir 30.

Figure 5:
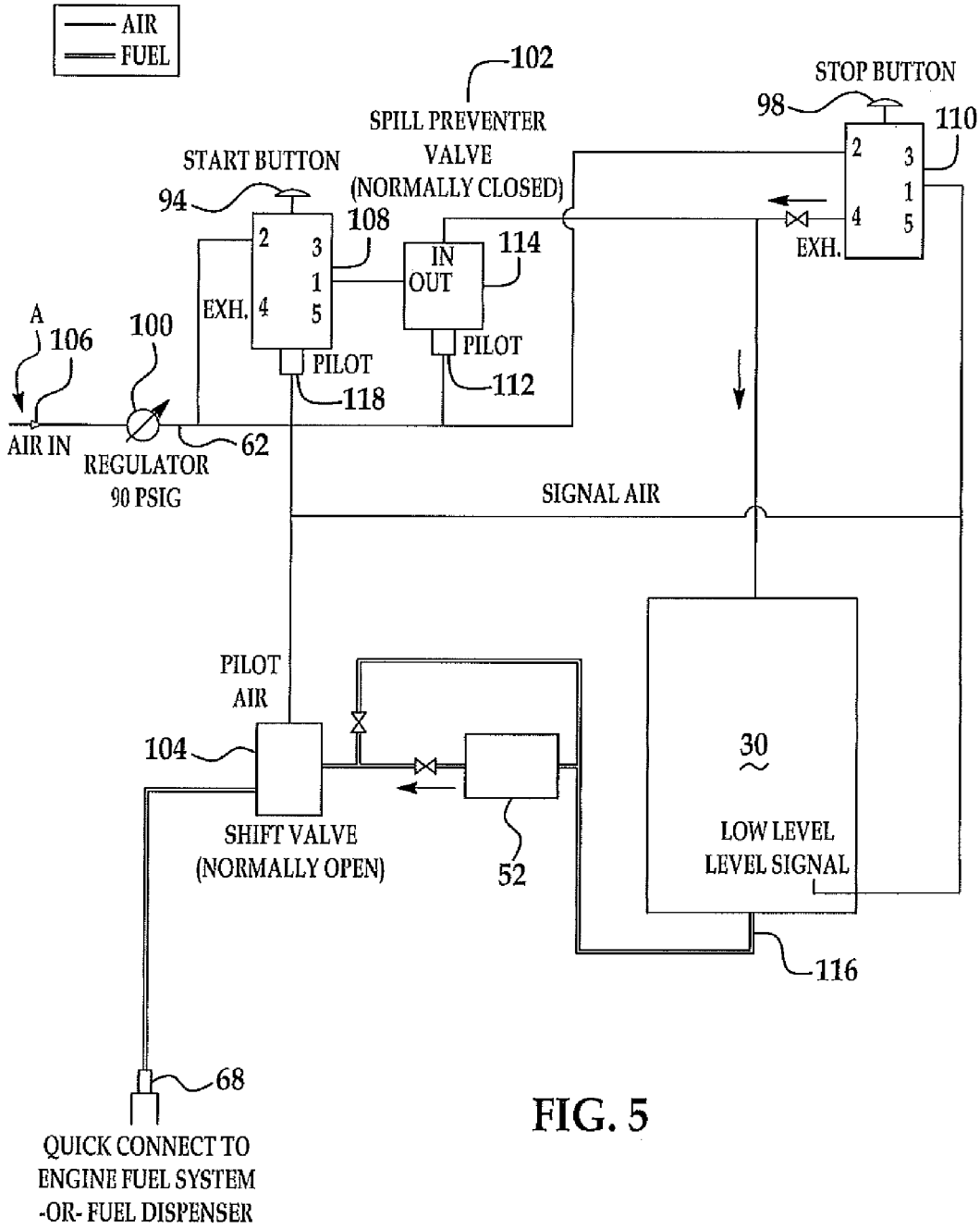
FIG. 5 is a schematic diagram of an embodiment of the device disclosed herein.

When the fluid level reaches the lower set level, $V_2$ defined by float 68, pressure exerted in the reservoir 30 is discontinued. The signal to discontinue pressure exertion can be transmitted by a suitable pneumatic circuit as illustrated in FIG. 5. Fluid level below V2 result in movement of float 70 and introduction of pressurized air into line 72 triggering valve 74 (normally closed) to open discharging pressure to atmosphere. The conveyance of pressurized air through to valve 76 located in the fuel conveyance line (normally open) causes it to close terminating the flow of fuel therethrough. It is also contemplated that the device 10 will be equipped with suitable environmental filters to treat and/or collect any hydrocarbons or other contaminant in the exhaust gas.

The amount of fuel introduced and/or the rate of fuel introduction can be controlled by the device 10 utilizing pneumatic constructs as desired or required. It is contemplated that the device 10 can be outfitted with a suitable priming initiation system 90 to commence priming operations for a given engine. In the embodiments depicted in the drawing figures, the priming initiation system 90 is configured as a control panel or box 92 having a suitably configured pneumatic system in which activation of the "on" switch 94 sends air into the pressurizable reservoir at a regulated pressure. Thus the circuit can have one or more regulators such as regulator 100. In the embodiment as depicted, depression of the "on" switch 94 opens a suitable valve to pressurized shop air and acts on a spill preventer valve 102 connected with the associated pneumatic circuit (normally closed when the device is not in use and during transit) to open the valve 102 and the associated pressurizable reservoir to the introduction of pressurized air.

The control box 92 can also be fitted with a suitable off switch 98 configured and useable as an emergency kill switch. The off switch 98 is configured and acts upon the pneumatic circuit to stop pressurization and/or vent the reservoir 30 to atmosphere. It is generally contemplated that the cycle, once initiated, will run to completion. Completion is triggered by removal of the specified amount of fuel from the pressurizable fuel reservoir to the engine to be primed. This event can be determined by volumetric measure, pressure analysis, timing, etc.

Activation of switch 94 opens a line 62 for the delivery of pressurized gas at a suitable operating pressure (for example 80 to 100 psi) into the reservoir 30. In order to prevent or minimize the potential for spillage, it is contemplated that the pressurized air delivery line can include suitable check valve and the like of which the manual cutoff valve 48 is one non-limiting example and the suitable internal ball valves (not shown) and shaft valves 104 are others. In various embodiments, it is contemplated that the internal valve such as a ball valve can be utilized to permit fuel filling (open position) while preventing backflow of fuel during operation and transit of the device 10.

The device disclosed herein can be employed to accomplish filter change operations in diesel engines, particularly diesel engines with large volume filter units. In the filter change method disclosed herein, it is contemplated that the diesel fuel contained in the associated old filter(s) can be collected in a suitable manner and new replacement filters put in position. Any fuel removed from the engine into the device can be combined with additional priming material as desired or required and the resulting material reintroduced under pressure to prime the high pressure pump.

Alternative uses for the device 10 include priming, particularly high pressure pump priming after routine repairs.

In the process, shop air is connected to the device 10 as at 106, bringing pressure to Port 2 at the Start Button Assembly 108 and Port 2 of the Stop Button Assembly 110 as well as pilot at Spill Preventer Assembly Valve 114 (NC spring loaded valve), which opens the valve. Pressing the Start Button will send air pressure to Port 1, through the Spill Preventer Assembly valve 114 into the Reservoir 30. The air pressure pushes the fuel through the bottom opening 116, check valve, Fuel Filter 15, Shift Valve 104 to the Quick Connect Fitting, which connects to the engine fuel system or a fuel dispenser.

When the fuel level reaches the predetermined low level, air will enter through the low level switch 70. This (signal) air pressure will activate the pilot 118 of the Start Button Assembly, closing the valve and shutting off the air supply to the tank and will close the Shift Valve 104, stopping the flow of fuel. Signal air will exhaust through the Spill preventer Valve 102, via Port 1 and Port 4 (exhaust) of the Start Button Assembly. Note that there must be air pressure to the Spill Preventer Valve to keep this valve open.for the exhaust.

Pressing the Stop Button 98 sends air from Port 2 to Port 1 into the signal air line, with the same result as when the fuel level is too low, in effect mimicking a low fuel signal. Releasing the Stop button 98 allows the air pressure to relieve via Port 4, through the check valve, the Spill Preventer Assembly and Port 1 and Port 4 of the Start Button Assembly. The Spill Preventer Assembly ensures that no fuel gets spilled in case the device 10 tips over and it also ensures that no fuel vapor escapes from the system.

In order to prime the associated engine with fuel, the device 10 is connected to the associated engine using the suitably matable quick connect fittings. Connection can occur at any suitable engine location. However, in various embodiments, it is contemplated that the connection can be a suitable compucheck type connection located in the fuel conveyance conduit between the low pressure pump and the high pressure pump. Once connected, the device can be pressurized and the fuel introduced into the engine to prime the system. Introduction occurs without dead space.

While the invention has been described in connection with what is presently considered to be the most practical and preferred embodiments, it is to be understood that the invention is not limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed:

1. A money saving universal fuel priming assembly comprising:

means for collecting a volume of fuel;

a pressurizable reservoir for holding a quantity of fuel;

a first conduit fluidly communicating between the fuel collecting means and the pressurizable reservoir;

at least one filtration device, configured to sequester at least a portion of contaminants contained in the fuel;

means for conveying pressurized air derived from a pressurized air source to the pressurizable reservoir for an interval sufficient to introduce fuel into contact with at least a high pressure fuel pump located in a fuel delivery system in an engine releasably connected to the fuel priming unit; and a second conduit in fluid communication with the pressurizable reservoir, the second conduit configured to be releasably connected with an engine to be primed, the second conduit located downstream of the filtration device.

2. The money saving universal fuel priming assembly of claim 1, further comprising a selectively opened drain in the pressurizable reservoir, said drain in fluid communication with the interior of the reservoir for drawing water therefrom, and means for selectively opening and closing the drain.

3. The money saving universal fuel priming assembly of claim 2, wherein the first conduit, the second conduit, and the reservoir are housed on a mobile unit transportable from one location to another.

4. The money saving universal fuel priming assembly of claim 3 further comprising:

at least one quick connect coupling member located on the second conduit distal to the pressurizable reservoir, the quick connect coupling member configured to releasably connect to a mating member located on the engine to be primed.

5. A money saving universal fuel priming assembly comprising:

means for collecting a volume of fuel;

a pressurizable reservoir for holding a quantity of fuel wherein the means for collecting a volume of fuel comprises a container positioned on a mobile unit at a location above the pressurizable reservoir when the primary assembly is in a use position;

a first fluid conduit fluidly communicating between the fuel collecting means and the pressurizable reservoir wherein the container comprises a closable lid and at least one drain opening communicating with the first fluid conduit, the drain opening positioned at a location opposed to the lid;

at least one filtration device, configured to sequester at least a portion of contaminants contained in the fuel;

means for conveying pressurized air derived from a pressurized air source to the pressurizable reservoir for an interval sufficient to introduce fuel into contact with at least a high pressure fuel pump located in a fuel delivery system in an engine releasably connected to the fuel priming unit; and a second conduit in fluid communication with the pressurizable reservoir, the second conduit configured to be releasably connected with an engine to be primed, the second conduit located downstream of the filtration device.

6. The money saving universal priming unit of claim 5 further comprising a pneumatic control system, the pneumatic control system configured to introduce fuel into the engine at an elevated pressure over an extended interval.

7. The money saving universal priming unit of claim 6 wherein the elevated pressure is at least 75 psi and the interval is at least two minutes.

* * * * *